US007380421B1

(12) United States Patent
Liu

(10) Patent No.: US 7,380,421 B1
(45) Date of Patent: Jun. 3, 2008

(54) FABRIC

(75) Inventor: Sheng-Nan Liu, Pa-Deh (TW)

(73) Assignee: Ruey Tay Fibre Industry Co., Ltd., Pa-Deh, Tao Yuan Hsien (TW)

( * ) Notice: Subject to any disclaimer, the term of this patent is extended or adjusted under 35 U.S.C. 154(b) by 0 days.

(21) Appl. No.: 11/673,354

(22) Filed: Feb. 9, 2007

(51) Int. Cl.
*D04B 7/12* (2006.01)

(52) U.S. Cl. ..... 66/196; 66/192

(58) Field of Classification Search ..... 66/190, 66/191, 192, 193, 194, 195, 196, 202; 442/318, 442/319

See application file for complete search history.

(56) References Cited

U.S. PATENT DOCUMENTS 2,921,456 A * 1/1960 Evans ..... 66/176
2,921,457 A * 1/1960 Evans ..... 66/176
3,307,379 A * 3/1967 Adams et al. ..... 66/178 R
4,133,191 A * 1/1979 Blore et al. ..... 66/197
4,601,940 A * 7/1986 Fischer ..... 428/178
4,787,219 A * 11/1988 Sato et al. ..... 66/190
5,501,891 A * 3/1996 Saika et al. ..... 428/71
5,787,503 A * 8/1998 Murphy, III ..... 2/90
5,807,295 A * 9/1998 Hutcheon et al. ..... 602/42
5,972,477 A * 10/1999 Kim et al. ..... 428/175
6,630,414 B1 * 10/2003 Matsumoto ..... 442/1
6,644,070 B2 * 11/2003 Ikenaga et al. ..... 66/196
6,758,068 B2 * 7/2004 Shirasaki et al. ..... 66/195
7,235,504 B2 * 6/2007 Shirasaki et al. ..... 442/314

* cited by examiner

*Primary Examiner*—Danny Worrell
(74) *Attorney, Agent, or Firm*—Townsend and Townsend and Crew, LLP

(57) ABSTRACT

A fabric has an upper layer and a lower layer. The lower layer connects partially to the upper layer to integrally form multiple connecting segments formed on the upper layer and the lower layer. The at least one channel is formed on the upper layer and the lower layer and is formed respectively between adjacent connecting segments. The fabric is produced by a sewing step and a connecting step. The sewing step comprises sewing multiple raw fibers to respectively form the upper layer and the lower layer. The connecting step comprises connecting partially the upper layer to the lower layer by fiber to integrally form the connecting segments and the at least one channel. Thus, time and a cost of a production of the fabric can be reduced to relieve customers' burdens.

4 Claims, 4 Drawing Sheets

FABRIC

BACKGROUND OF THE INVENTION

1. Field of Invention

The present invention relates to a fabric, and more particularly to a fabric that has at least one channel formed integrally with the fabric to reduce a cost of the fabric.

2. Description of the Related Art

A normal sewing machine can produce only a piece of fabric. However, the fabric such as a bra may be thickened partially to make people comfortable when they wear the fabric.

A conventional fabric with at least one channel is formed by following three steps:

(1) multiple upper layers and multiple lowers layer are formed respectively;

(2) a normal sewing machine is used to sew some of the upper layers respectively on some of the lower layers to form multiple connecting segments;

(3) a double needle bar warp knitting machine for simplex fiber is used to sew remains of the upper layers and remains of the lower layers to form at least one single channel; and (4) the at least one channel is sewed respectively between the connecting segments to form the fabric with multiple channels.

Each of the at least one channel may be filled with fillers to partially thicken the fabric. However, the conventional fabric with the at least one channel is formed by complex procedure that wastes time. Thus, a cost of the fabric with the at least one channel will increase and customers have to pay more to get the fabric.

To overcome the shortcomings, the present invention provides a fabric to mitigate or obviate the aforementioned.

SUMMARY OF THE INVENTION

The primary objective of the present invention is to provide a fabric that has at least one channel formed integrally with the fabric to reduce a cost of the fabric.

To achieve the objective, the fabric in accordance with the present invention has an upper layer and a lower layer. The lower layer connects partially to the upper layer to integrally form multiple connecting segments and at least one channel. The connecting segments are formed on the upper layer and the lower layer. The at least one channel is formed on the upper layer and the lower layer and is formed respectively between adjacent connecting segments. The fabric is produced by a sewing step and a connecting step. The sewing step comprises sewing multiple raw fibers to respectively form the upper layer and the lower layer. The connecting step comprises connecting partially the upper layer to the lower layer by fiber to integrally form the connecting segments and the at least one channel.

Thus, time and a cost of a production of the fiber of the present invention can be reduced to relieve customers' burdens.

Other objectives, advantages and novel features of the invention will become more apparent from the following detailed description when taken in conjunction with the accompanying drawings.

DETAILED DESCRIPTION OF THE INVENTION

Figure 1:
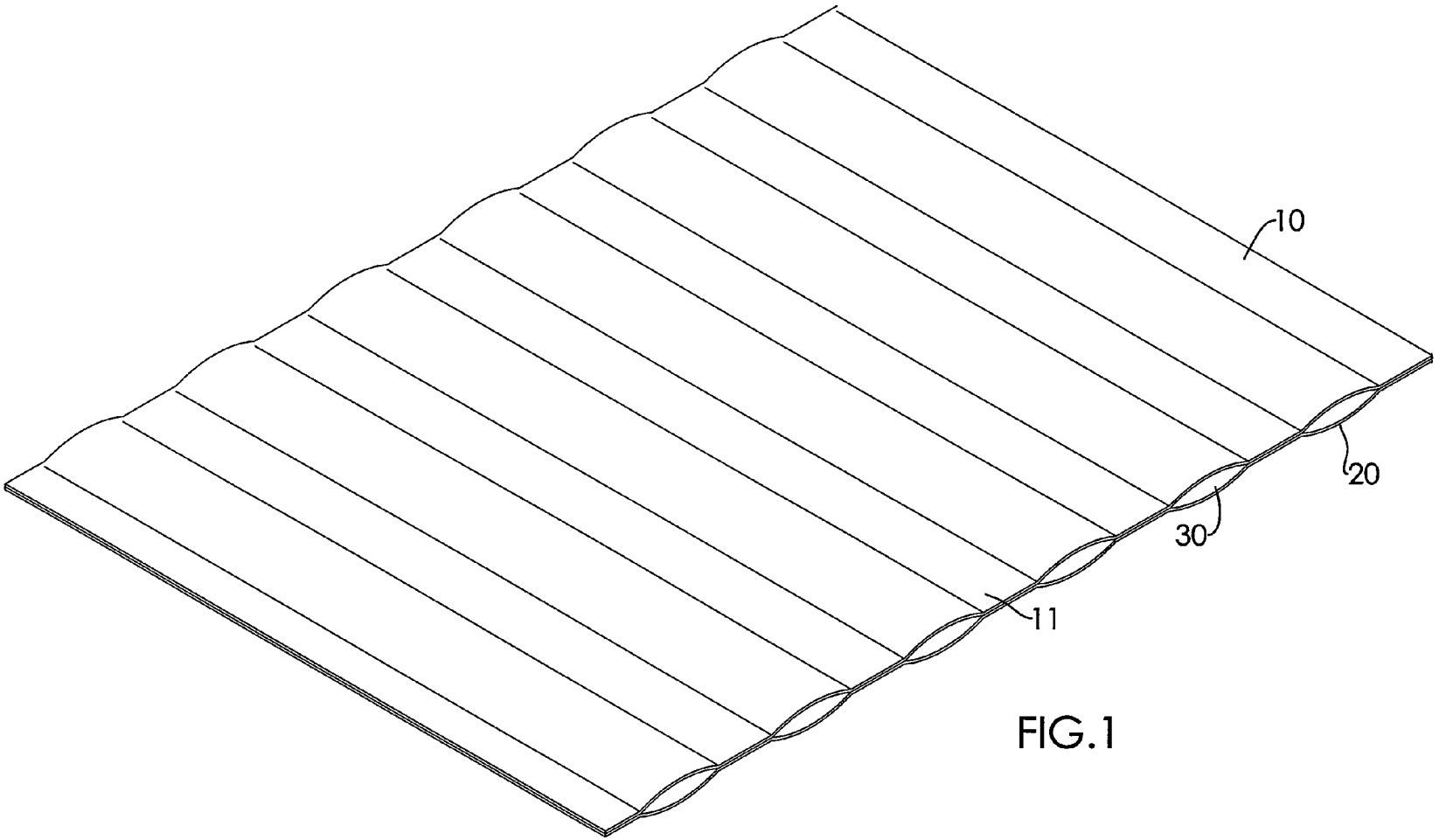
FIG. 1 is a perspective view of a fabric in accordance with the present invention with an upper layer connecting directly to a lower layer.
Figure 2:
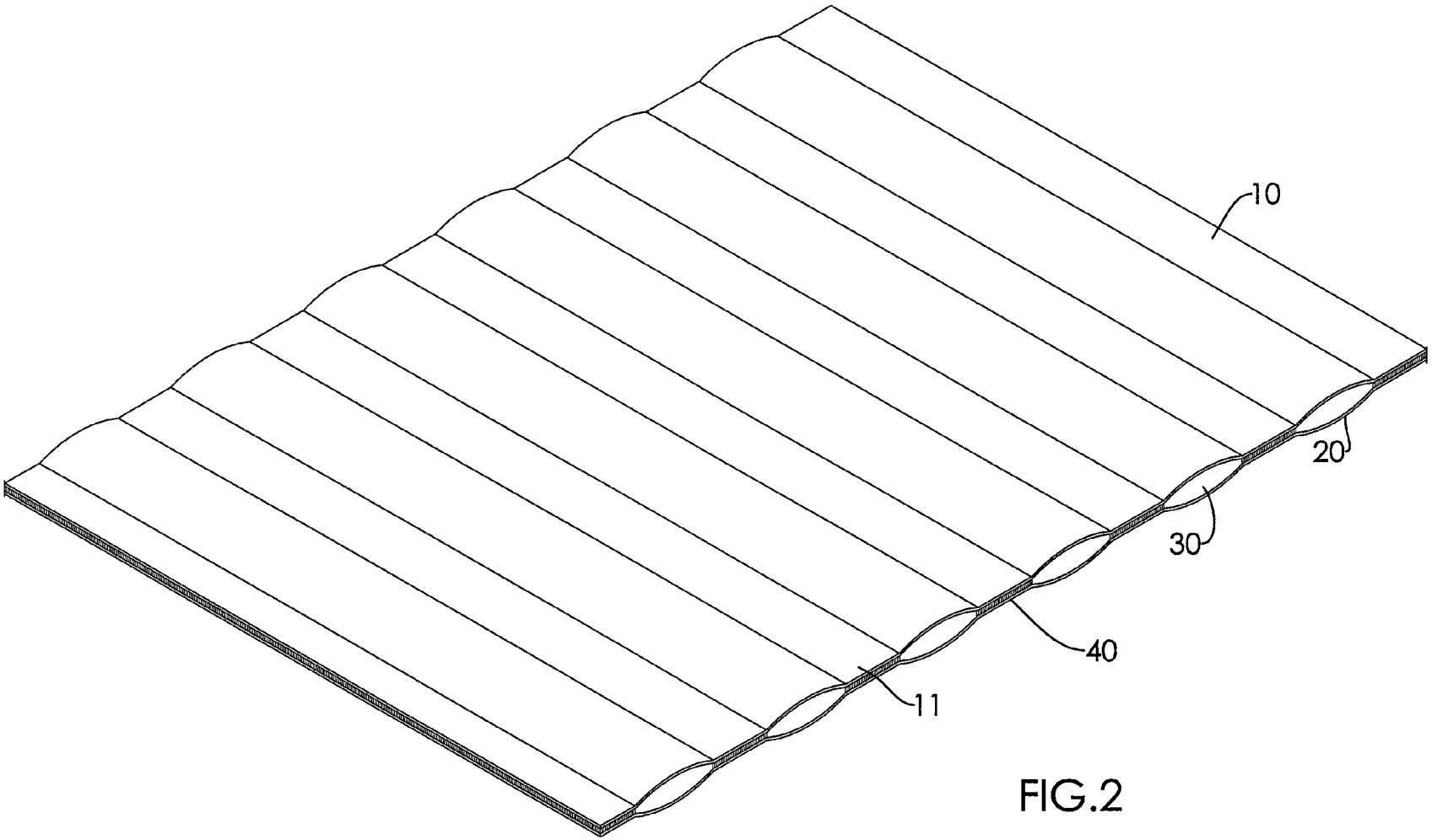
FIG. 2 is a perspective view of a fabric in accordance with the present invention with multiple connecting segments and each connecting segment having a middle layer between an upper layer and a lower layer.

With reference to FIGS. 1 and 2, a fabric in accordance with the present invention has an upper layer (10) and a lower layer (20).

The upper layer (10) has a thickness.

The lower layer (20) connects partially to the upper layer (10) to form multiple integral connecting segments (11) and at least one channel (30) and has a thickness.

Figure 3:
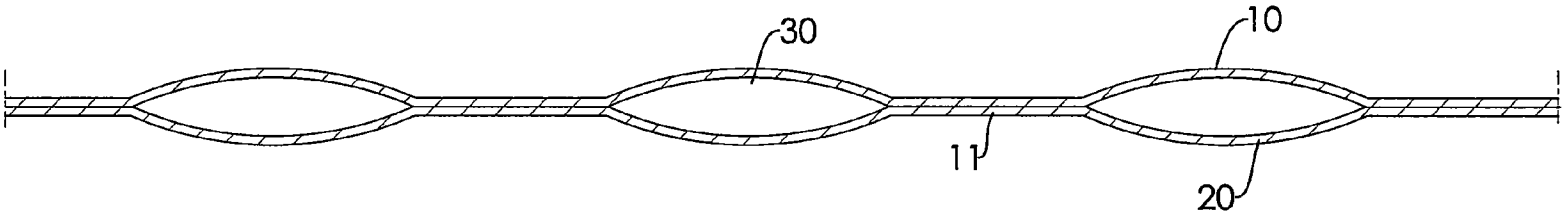
FIG. 3 is a cross sectional side view of the fabric in FIG. 1.
Figure 4:
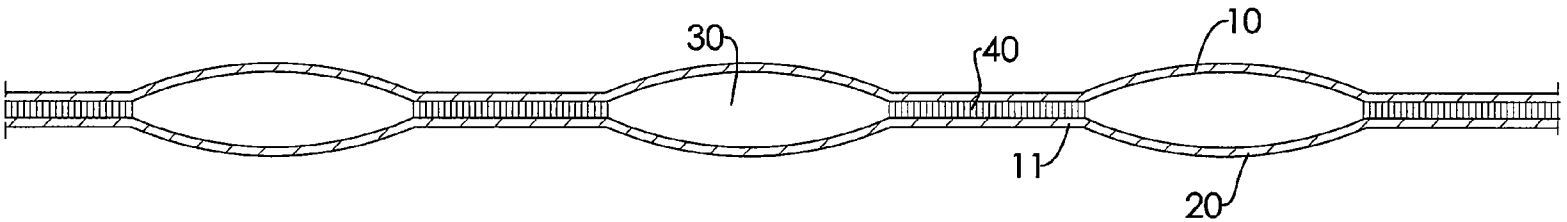
FIG. 4 is a cross sectional side view of the fabric in FIG. 2.

With further reference to FIGS. 3 and 4, the connecting segments (11) are formed integrally on the upper layer (10) and the lower layer (20) at intervals and has a thickness. Each connecting segment (11) may be formed by weaving the upper layer (10) directly with the lower layer (20), so the thickness of the connecting segment (11) is a sum of the thickness of the upper layer (10) and the thickness of the lower layer (20). Each connecting segment (11) may have a middle layer (40). The middle layer (40) is formed between the upper layer (10) and the lower layer (20) to thicken the thickness of the connecting segment (11). The middle layer (40) may be made of elastic yarn to allow the connecting segment (11) to have elasticity.

The at least one channel (30) is formed integrally on the upper layer (10) and the lower layer (20) when the upper layer (10) connects to the lower layer (20) and is formed respectively between adjacent connecting segments (11) so that the connecting segments (11) and the at least one channel (30) are arranged alternately in a row.

Figure 5:
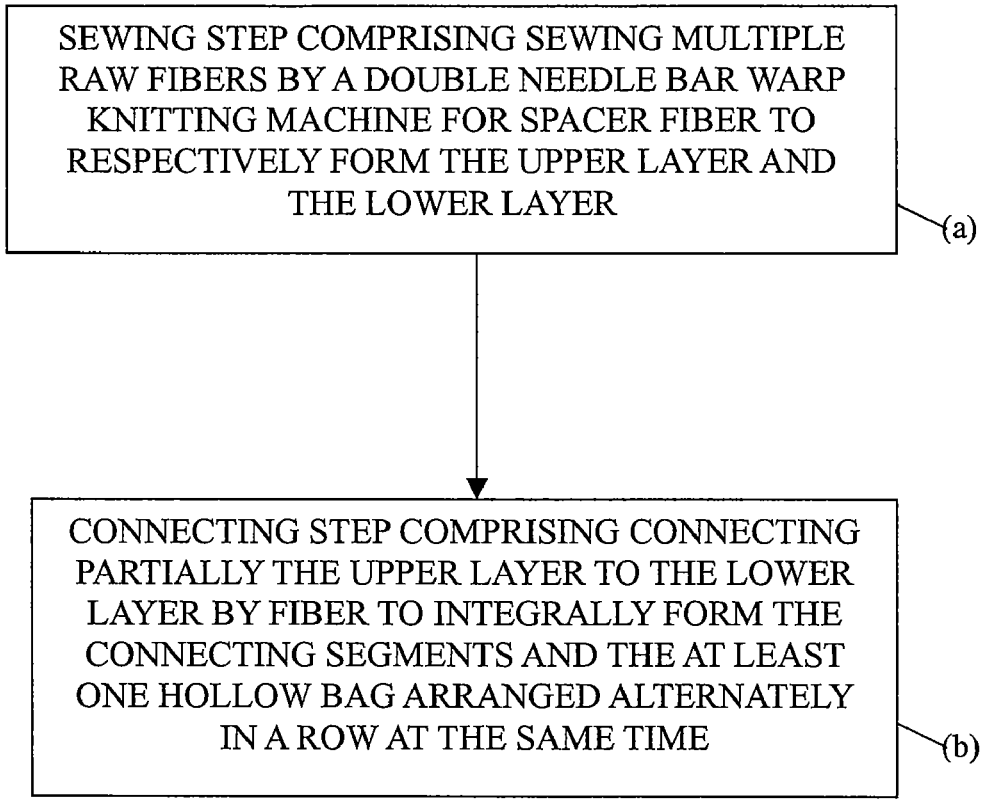
FIG. 5 is a flow chart of a process forming a fabric in accordance with the present invention.

With further reference to FIG. 5, the fabric is produced by a method having a sewing step (a) and a connecting step (b).

The sewing step (a) comprises sewing multiple raw fibers by a double needle bar warp knitting machine for spacer fiber to respectively form the upper layer (10) and the lower layer (20).

The connecting step (b) comprises connecting the upper layer (10) partially to the lower layer (20) by fiber such as yarn or elastic yarn to integrally form the connecting segments (11) and the at least one channel (30) arranged alternately in a row at the same time.

The fabric formed by the two steps above is more simple and faster than that formed by a conventional steps. Thus, time and a cost of a production of the fabric of the present invention can be reduced to relieve customers' burdens.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A fabric having an upper layer;

a lower layer connecting partially to the upper layer to integrally form multiple connecting segments and at least one channel;

the connecting segments formed integrally on the upper layer and the lower layer at intervals; and the at least one channel formed integrally on the upper layer and the lower layer and formed respectively between adjacent connecting segments; and wherein the fabric is produced by a method having a sewing step comprising sewing multiple raw fibers by a double needle bar warp knitting machine for spacer fiber to respectively form the upper layer and the lower layer; and a connecting step comprising connecting partially the upper layer to the lower layer by fiber to integrally form the connecting segments and the at least one channel arranged alternately in a row at the same time.

2. The fabric as claimed in claim 1, wherein the upper layer has a thickness;

the lower layer has a thickness; and each connecting segment is formed by weaving the upper layer directly with the lower layer and has a thickness being a sum of the thickness of the upper layer and the thickness of the lower layer.

3. The fabric as claimed in claim 1, wherein each connecting segment has a thickness; and a middle layer formed between the upper layer and the lower layer to thicken the thickness of the connecting segment.

4. The fabric as claimed in claim 3, wherein the middle layer is made of elastic yarn.

* * * * *